US007137200B2

(12) United States Patent
Shepherd et al.

(10) Patent No.: US 7,137,200 B2
(45) Date of Patent: Nov. 21, 2006

(54) METHOD OF CONSTRUCTING A BUOY

(75) Inventors: Fred Shepherd, Aberdeen (GB); Martin Kobiela, Udny (GB); Mark Olson, Aberdeen (GB)

(73) Assignee: Trident Offshore Ltd (GB)

( * ) Notice: Subject to any disclaimer, the term of this patent is extended or adjusted under 35 U.S.C. 154(b) by 107 days.

(21) Appl. No.: 10/914,606

(22) Filed: Aug. 9, 2004

(65) Prior Publication Data

US 2005/0081357 A1 Apr. 21, 2005

(30) Foreign Application Priority Data

Aug. 13, 2003 (GB) ..... 0319015.4

(51) Int. Cl.
*B63B 22/00* (2006.01)
*B23P 11/00* (2006.01)
*B23P 17/00* (2006.01)

(52) U.S. Cl. ..... 29/897; 29/428; 29/469; 114/266

(58) Field of Classification Search ..... 29/428, 29/525.14, 469, 897, 897.31, 897.32; 441/3, 441/4, 5; 114/266, 230.1
See application file for complete search history.

(56) References Cited

U.S. PATENT DOCUMENTS 3,365,734 A * 1/1968 Petrie et al. ..... 441/5
3,665,882 A * 5/1972 Georgiev et al. ..... 114/226
3,951,085 A * 4/1976 Johnson et al. ..... 114/266
4,067,285 A * 1/1978 Jones et al. ..... 114/266
5,269,061 A * 12/1993 Geckle ..... 29/897.312
5,297,899 A * 3/1994 Culley ..... 405/219
5,347,703 A * 9/1994 Imashimizu et al. ..... 29/525.11
5,651,709 A * 7/1997 Nandakumar et al. ..... 441/5
5,816,183 A * 10/1998 Braud et al. ..... 114/230.13

FOREIGN PATENT DOCUMENTS

GB 2068845 A * 8/1981

* cited by examiner

*Primary Examiner*—Jermie E. Cozart
(74) *Attorney, Agent, or Firm*—Michael Y Epstein

(57) ABSTRACT

Buoys are used for mooring purposes and as navigational marks. An embodiment of the invention is be explained in relation to catenary anchor leg mooring (CALM) buoys.

Conventional CALM buoys generally have a hull constructed of steel plate by traditional ship building techniques requiring plate benders. Webs, beams and girders are welded inside the hull which is divided into several tanks. The buoy has a central moonpool and a steel turntable. Bending plate, in effect, doubles its cost.

A method of constructing a buoy is disclosed, comprising: constructing a framework and affixing flat steel plate to it.

3 Claims, 3 Drawing Sheets

METHOD OF CONSTRUCTING A BUOY

CROSS REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC (see 37 CFR 1.52 (*e*)(5) and MPEP 608.05. Computer program listings (37 cfr 1.96(c)), "Sequence Listings" (37 CFR 1.821 (c)), and tables having more than 50 pages of text are permitted to be submitted on compact discs.) or REFERENCE TO A "MICROFICHE APPENDIX" (See MPEP § 608.05(a). "Microfiche Appendices" were accepted by the Office until Mar. 1, 2001.)

Not Applicable

BACKGROUND OF THE INVENTION (1) Field of the Invention

This invention relates to buoys.

(2) Description of Related Art Including Information Disclosed Under 37 CFR 1.97 and 1.98.

Buoys are used for mooring purposes and as navigational marks. The invention will be explained in relation to catenary anchor leg mooring buoys but, it will be appreciated, may be applicable to buoys of other types. Conventional catenary anchor leg mooring (CALM) buoys are used extensively to facilitate offshore marine terminals for the import or report of crude oil (and other fluids).

A CALM buoy is generally moored to a 4, 6 or 8 point mooring system (dependent upon operational requirements, environmental conditions, water depth etc). The tanker to be loaded (or offloaded) moors directly to the buoy and connects to a floating hose which carries the fluid product.

The fluid hose and the mooring assembly arrangements on a CALM buoy are swivel mounted in order that the tanker can "weathervane" around the buoy thus maintaining a heading into the wind/weather at all times.

The use of CALM buoy provides a low cost marine terminal as dedicated port or harbour facilities are not required for tanker mooring. The CALM buoy design allows the tanker to moor directly to the buoy and a fluid transfer pipeline may run from a shore facility to the CALM buoy.

Conventional CALM buoys have been in use in the offshore industry for many years and have proved to be a cost efficient method for the transfer of petroleum products from a seabed production facility to an off take tanker (or vice versa).

Conventional CALM buoys generally take the form of a large steel cylinder with a central opening or so-called "moonpool" and a rotating turntable or arm section fitted to the top of the buoy. Generally the turntable is made up of three "arms", the mooring arm, the off take arm and a counterbalance arm.

The tanker is moored to the mooring arm of the turntable via a hawser mooring system. The tanker is free to weathervane around the buoy by the mooring loads applying rotational forces to the turntable. The turntable is fitted to the main body of the buoy via a large slew bearing arrangement.

A riser/hose system is connected from the seabed facility to a fluid swivel located in the centre of the moonpool. The output flange of the fluid swivel is connected to a pipe that is fixed onto the turntable's off take arm and leads off the buoy to an off take hose connected to the tanker.

The main body of the buoy is generally moored to the seabed via four, six or eight mooring lines. The method used to tension and attach the mooring lines to the buoy differs between designs, but generally the lines are tensioned with an onboard winch and gantry arrangement also used for attaching the mooring hawser and off take hoses. The mooring lines are then locked into place by a locking device such as a chain stopper. The components of the mooring system are dependent on the water depth, the environment associated with the location where the buoy is to be moored, and the size of the off take tanker.

Conventional CALM buoys generally have a hull constructed of steel plate by traditional ship building techniques requiring plate benders. Webs, beams and girders are welded inside the hull which is divided into several tanks. The buoy has a central moonpool and a steel turntable. Bending plate, in effect, doubles its cost.

BRIEF SUMMARY OF THE INVENTION

Against this background, in accordance with the invention, there is provided a method of constructing a buoy, comprising: constructing a framework and affixing flat steel plate to it.

In another aspect, the invention extends to a method of constructing a buoy, comprising constructing a separate framework for each of a plurality of modules; affixing steel plate to the frameworks; and assembling the modules to form the buoy. This has the additional benefit of reducing the space needed to manufacture the modules, compared to a complete buoy and facilitates transport since the modules can be transported separately and assembled close to the site where the buoy will be launched. Small manufacturing facilities can thus be used distant from the launch site.

In this method, the modules are preferably broadly identical and triangular in plan, and include plate on only two sides of the triangle, the other side being open, so that when assembled the open side of one module is closed by the plated side of the adjacent module, dividing the hull into separate tanks.

BRIEF DESCRIPTION OF THE SEVERAL VIEWS OF THE DRAWINGS

One embodiment of the invention, and an example of the method, will now be described with reference to the accompanying drawings, in which.

DETAILED DESCRIPTION OF THE INVENTION

Figure 1:
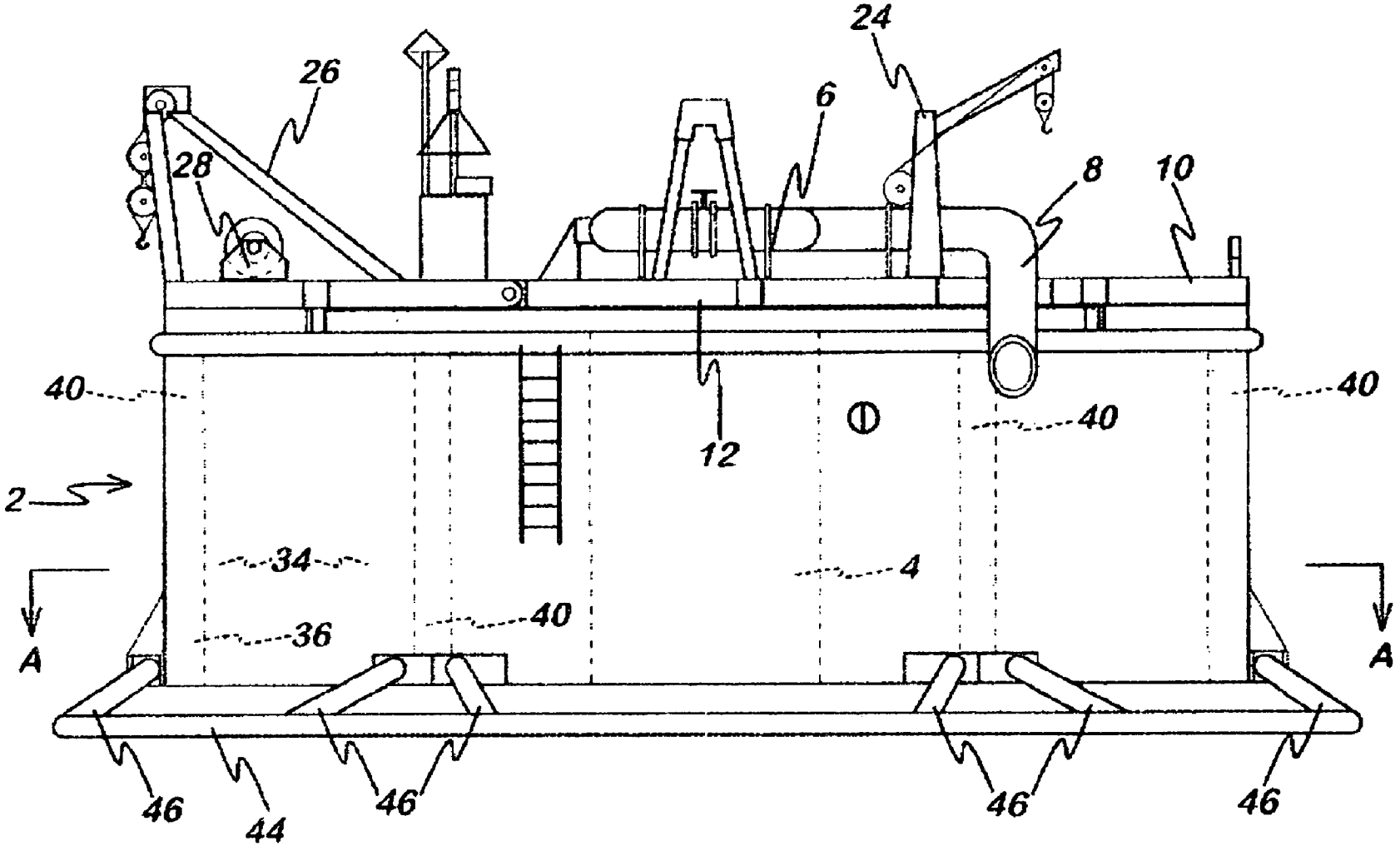
FIG. 1 is a side view of a CALM buoy embodying the invention.
Figure 2:
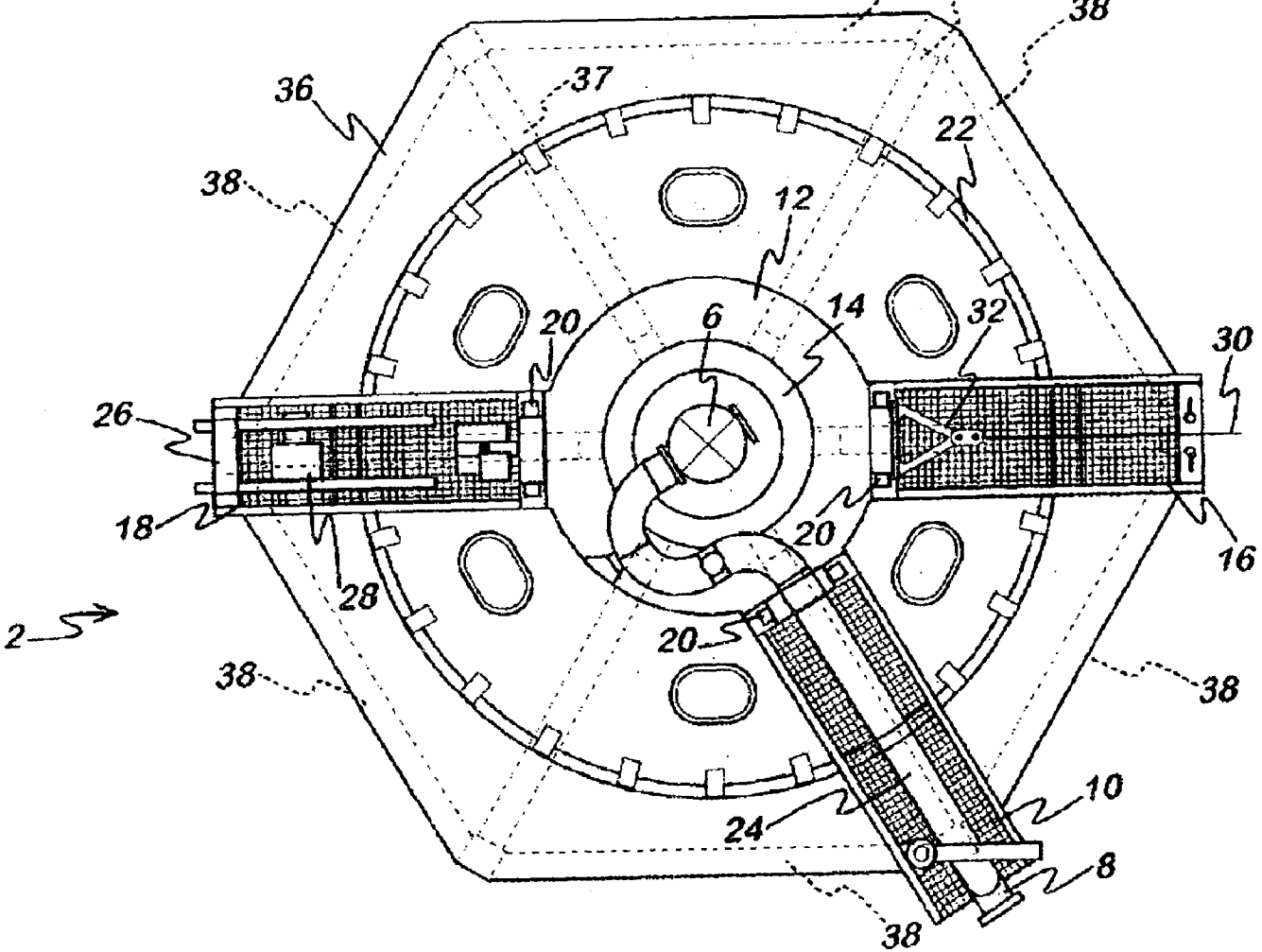
FIG. 2 is a plan view of the buoy of FIG. 1.

The buoy has a hull 2 which is hexagonal in plan. The hull 2 has a central moon pool up which an oil supply riser (not visible) runs to a swivel thence to a take off hose 8 to which a tanker connects. The take off hose 8 is supported on one arm 10 of a turntable 12. This is supported centrally by a main bearing. Arms 10, 16 and 18 are pivoted by pins 20 and supported by a load bearing ring 22 so as to be able to swivel with the turntable around the moon pool.

The arm 24 has a davit 26 for handling the off take hose 8. The arm 18 has a davit 26 and winch 28 for handling the buoy's mooring chains which are attached to anchor chain stoppers supported by brackets 29. A tanker, not shown, moors to the arm 16 by means of a hawser 30 for which purpose the arm is provided with a hawser hanger 32.

The hull 2 is constructed of flat steel plate 34 welded to a framework 36 welded up from square hollow section steel. There are horizontal members 38 top and bottom and vertical members 40. In one method of construction the complete framework is welded up and flat plate welded to it. Note that the bottom plates of the hull are stiffened by a lattice of internal stiffeners 42. Plates divide the hull into roughly triangular tanks.

Figure 3:
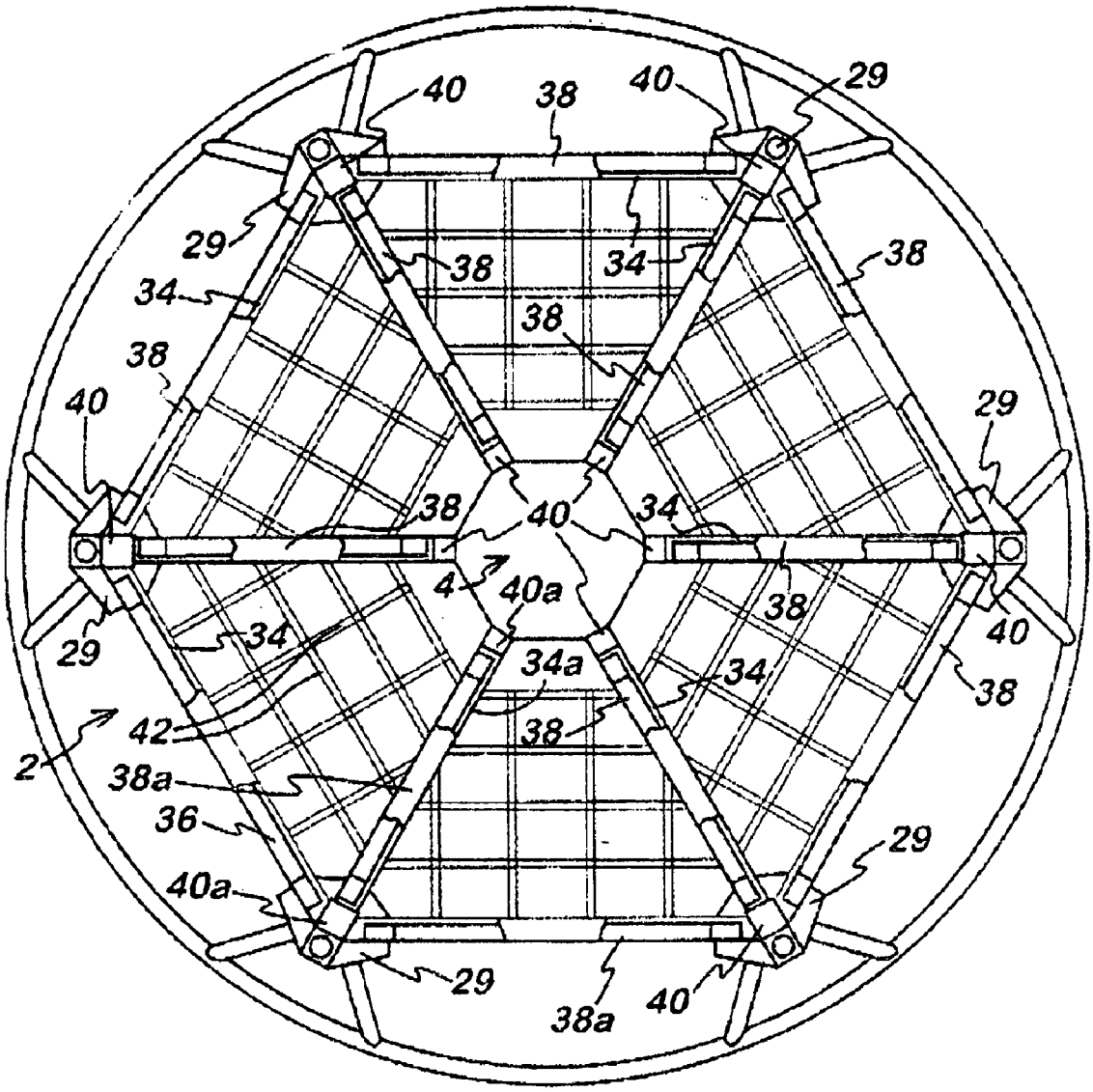
FIG. 3 is a cross section on arrows A—A of FIG. 1.

In another method the construction is modular. In plan a generally triangular framework is constructed for each module. Referring to FIG. 3, a module framework is constructed of three vertical members 40*a* and four horizontal members 38 (two at the top and two at the bottom). The bottom, outside and one divider of the framework are then plated. The plating which forms the moon pool may be affixed at this stage or later.

For the hexagonal hull illustrated six identical modules are built and these can be transported individually to an assembly site near the buoy's launch site. Here final assembly takes place the modules being welded together to form the complete hull with its internal divisions. If not added earlier, plates are added to form the moon pool.

As the method of construction leads to the buoy having corners, an anti collision ring 44 is added. This is supported on arms 46 and is round in section. It is cornerless, e.g. circular.

The invention claimed is:

1. A method of constructing a buoy, comprising constructing a separate framework for each of a plurality of modules; affixing steel plate to the frameworks; and assembling the modules to form the buoys, wherein the modules are broadly identical and triangular in plan, and include plate on only two sides of the triangle, the other side being open, so that when assembled the open side of one module is closed by the plated side of the adjacent module, dividing the buoy into separate compartments.

2. A method as claimed in claim 1, including constructing the frameworks from square hollow section steel.

3. A method as claimed in claim 1 wherein the plate is flat.

* * * * *